US007477208B2

(12) United States Patent
Matlock et al.

(10) Patent No.: US 7,477,208 B2
(45) Date of Patent: Jan. 13, 2009

(54) ROTATIONAL LIGHT EMITTING DISPLAY APPARATUS

(76) Inventors: Dan Matlock, RR #2, Airdrie, Alberta (CA) T4B 2A4; Peter Matlock, RR #2, Airdrie, Alberta (CA) T4B 2A4

( * ) Notice: Subject to any disclaimer, the term of this patent is extended or adjusted under 35 U.S.C. 154(b) by 647 days.

(21) Appl. No.: 10/775,694

(22) Filed: Feb. 11, 2004

(65) Prior Publication Data

US 2005/0174308 A1 Aug. 11, 2005

(51) Int. Cl.
*G09G 3/00* (2006.01)

(52) U.S. Cl. ..... 345/31; 345/110; 345/659

(58) Field of Classification Search ..... 345/31–39, 345/110, 619, 659; 340/815.45, 444, 441
See application file for complete search history.

(56) References Cited

U.S. PATENT DOCUMENTS

| | | | | |
|---|---|---|---|---|
| 4,631,848 | A | 12/1986 | Iwasa et al. | |
| 5,016,144 | A | 5/1991 | DiMaggio | |
| 5,791,966 | A * | 8/1998 | Capps et al. | 446/242 |
| 5,800,039 | A | 9/1998 | Lee | |
| 5,903,224 | A | 5/1999 | Reynolds | |
| 5,949,346 | A * | 9/1999 | Suzuki et al. | 340/815.45 |
| 6,030,106 | A | 2/2000 | Johnson | |
| 6,037,876 | A | 3/2000 | Crouch | |
| 6,072,386 | A | 6/2000 | Yu | |
| 6,265,984 | B1 | 7/2001 | Molinaroli | |
| 6,322,237 | B1 | 11/2001 | Lee | |
| 6,492,963 | B1 | 12/2002 | Hoch | |
| 6,641,041 | B2 | 11/2003 | Olds et al. | |
| 6,644,839 | B2 | 11/2003 | Lee | |
| 6,936,980 | B2 | 8/2005 | Wang | |
| 7,046,131 | B2 * | 5/2006 | Todorox | 340/444 |
| 7,079,042 | B2 * | 7/2006 | Reim | 340/815.45 |
| 2002/0135541 | A1 * | 9/2002 | Kowalewski | 345/31 |
| 2003/0151924 | A1 * | 8/2003 | Gloodt et al. | 362/500 |
| 2004/0130905 | A1 * | 7/2004 | Olds et al. | 362/487 |
| 2004/0162127 | A1 * | 8/2004 | Siegel et al. | 463/9 |

FOREIGN PATENT DOCUMENTS

| | | |
|---|---|---|
| WO | WO 98/59333 | 12/1998 |
| WO | WO 03/021562 | 3/2003 |

* cited by examiner

*Primary Examiner*—Sumati Lefkowitz
*Assistant Examiner*—Rodney Amadiz
(74) *Attorney, Agent, or Firm*—Maxey Law Offices, PLLC; Stephen Lewellyn; Brittany J. Maxey

(57) ABSTRACT

A rotational light emitting display apparatus is provided. The rotational light emitting apparatus device allows static and animated images and instruments to be displayed on dynamic screen. The display is refreshed repeatedly to take advantage of the persistence of vision property of the human eye. The illuminating element of the apparatus includes a plurality of light emitting elements arranged in a line. Display refreshing is accomplished by mounting the apparatus on a rotating object, so that the line of light emitting elements lies along a radial direction. In this way, each of the light emitting elements traverse a circular path, while being flashed on and off to produce the desired display.

10 Claims, 4 Drawing Sheets

ROTATIONAL LIGHT EMITTING DISPLAY APPARATUS

BACKGROUND OF THE INVENTION

1. Field of the Invention

The present invention relates generally to aesthetic and decorative illumination, illuminated instrumentation, and illuminated display of animation. More particularly, relating to a rotational light emitting display apparatus capable of achieving aesthetic and decorative illumination, illuminated instrumentation, and illuminated display of animation.

2. Description of the Prior Art

It is desirable to display aesthetic and decorative illumination, advertisement, warning signs or signals or the like on rotating objects or on objects which move along an arcuate path, such as but not limited to hand held displays, vehicle wheels and fans and the prior art has attempted to fulfill this need.

Examples of such prior art devices are described in the following U.S. patents: U.S. Pat. No. 6,265,984 to Molinaroli; U.S. Pat. No. 6,037,876 to Crouch; U.S. Pat. No. 5,800,039 to Lee; U.S. Pat. No. 6,072,386 to Yu; U.S. Pat. No. 5,903,224 to Reynolds; U.S. Pat. No. 6,030,106 to Johnson; U.S. Pat. No. 5,016,144 to DiMaggio; U.S. Pat. No. 6,641,041 to Olds et al.; and U.S. Pat. No. 6,492,963 to Hoch.

However, it is equally as desirable to display animated or dynamic aesthetic and decorative illumination, advertisement, warning signs or signals or the like on rotating objects and heretofore the prior art has not achieved this.

Therefore, a need exists for a new and improved rotational light emitting display apparatus that can be used for displaying animated or dynamic images on rotational objects. In this regard, the present invention substantially fulfills this need. In this respect, the rotational light emitting display apparatus according to the present invention substantially departs from the conventional concepts and designs of the prior art, and in doing so provides an apparatus primarily developed for the purpose of displaying animated or dynamic images on rotational objects.

SUMMARY OF THE INVENTION

In accordance with the present invention, a rotational light emitting display apparatus is provided. In an embodiment of the present invention the rotational light emitting display apparatus comprises a support, a plurality of light emitting elements affixed to the support and arranged in one or more generally parallel columns thereon, a microcontroller for controlling the illumination of the plurality of light emitting elements, a power source for providing electrical power to the display apparatus, and a means for sensing the rotational movement of the support about a center of rotation of the support.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
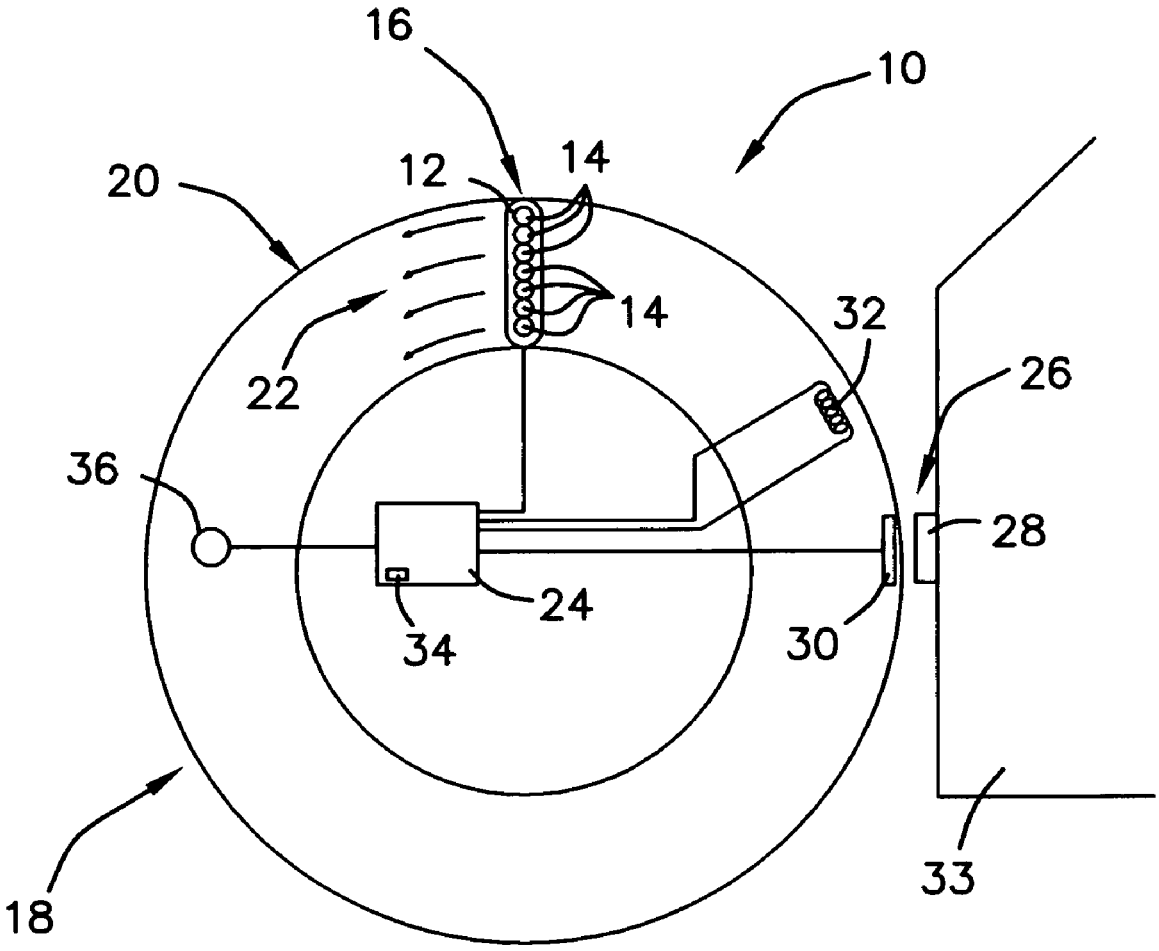
FIG. 1 is a schematic diagram of the preferred embodiment of the rotational light emitting display apparatus constructed in accordance with the principles of the present invention.

The present invention is a combination of hardware and software that flashes light emitting elements, such as light emitting diodes in such a way as to trace out an image or sequence of images when the apparatus is mounted on a rotating object.

For the purpose of this application for U.S. Letters Patent, the following terms are defined:

Rotational illumination is the affixation of a light or a plurality of lights to a rotational object to produce a sequence of pattern of light.

Light tail is defined as a plurality of light emitting elements, such a light emitting diodes affixed in a row and mounted along a radial direction on a rotational object.

Imaging is the electronic output of a predetermined image stored in memory.

Triggering is the steadying of an image scanned by Rotational Illumination via the positioning of a switching mechanism that is activated once or more per rotation. Thus the illumination device may begin to scan the image at the same angular position during each revolution.

Scaling is the adjustment of the size of a scanned image to fit or fill the rotational display area available.

Animation is the output of successive image frames of an animation in place of a single image. Since the successive frames must be coherent in the sense of a continuous animated motion, animation requires the use of at least rotational illumination, triggering and preferably scaling.

Instrumentation is the exhibition of either analogue or digital information via the display produced by the imaging device. Examples of instrumentation include the display of properties of the motion of a rotational object or quantities derived thereof. An analogue display can include an image of a needle on top of a gauge to display speed or acceleration of a vehicle in a traditional vehicle speedometer. While a digital display could involve displaying numerical figures corresponding to speed, acceleration or power of a vehicle. In addition, the linear speed, acceleration or power of a vehicle could be displayed in a similar fashion.

Self-Powering is the ability of the imaging device to derive its required electrical power from the rotational motion of the object to which the imaging device is attached.

Multi-Color is the application of a plurality of different light producing light emitting elements so that the display produced may contain different colors, typically produced by the alteration in time or space of elements of fundamental colors.

Referring now to the drawings, and particularly to FIGS. 1-5, a preferred embodiment of the rotational light emitting display apparatus of the present invention is shown and generally designated by the reference numeral 10.

In FIG. 1, a new and improved rotational light emitting display apparatus 10 of the present invention for displaying an image or sequence of images when the apparatus is mounted on a rotating object is illustrated and will be described. More particularly, the rotational light emitting display apparatus 10 has a support 12 including a plurality of light emitting elements 14, such as light emitting diodes arranged in one or more generally parallel rows 16. This arrangement of light emitting elements 14 attached to the support 12 creates a light tail. The support 12 is radially attached to a rotating object 18, and sweeps out an annulus 20 as the support rotates about the center of rotation of the rotating object to which it is attached. Each light emitting element 14 traces out a circular path indicated by arrows 22 in space within the annulus 20, with successive light emitting elements at successive radii. While only a single support 12 or light tail is shown attached to the rotating object 18, many supports can be attached. Additional supports 12 can be used to increase the resolution of the displayed image or to add color to displayed image. Color could also be added to the displayed image by including one or more different colored light emitting elements 14 on a single support 12.

A microprocessor 24 is connected to the plurality of light emitting elements 14 and during a complete revolution of the rotating object 18 the microcontroller flashes the light emitting elements according to an image map stored in memory, so that when viewed by humans a steady coherent image is displayed with the refresh rate of the image equal to the rotational frequency of the object. Preferably, the image is an animation and is superposed on the rotating object 18.

A means 26 for sensing the rotational movement and position of the support about a center of rotation of said support is in communication with the microprocessor 24. The microprocessor 24 uses a signal generated by the means 26 for sensing the rotational movement and position of the support to steady the image in the angular direction and to scale the image to fit in the annulus 20. Steadying of the image is accomplished by initiating or triggering the display of the image when the support 12 reaches a predetermined position along the rotational path of the support. Measuring the time period of the rotational frequency of the support and dynamically adjusting the pixel display rate accordingly accomplishes scaling of the image. This is done using a non-linear feedback algorithm, so that the image remains steady and full even during changes in rotational velocity of the support 12. Additionally, the microprocessor 24 controls the display of a sequence of a plurality of images, producing an animated display of images.

The means 26 for sensing the rotational movement and position of the support 12 can include a magnetic source 28 and a magnetic-field sensor 30. The magnetic source 28, such as a permanent magnet is mounted to a non-rotating object 33, which is in close proximity to the rotating object 18. The magnetic-field sensor 30 is attached to the rotating object 18 so that it passes the magnetic source 28 in close proximity thereto once during a single revolution of the rotating object.

A power source is also provided and can include a battery or preferably, the power source is self derived by the rotational light emitting display apparatus 10 through the use of a coil 32. The coil 32 is positioned so that is passes by the magnetic source 28 during rotation of the object 18 and generates an electrical current used to power the rotational light emitting display apparatus 10. If the coil 32 generates a surplus of electrical current, the extra energy can be stored in a capacitor for use during low current generation periods, such as when the rotating object 18 has a very low angular velocity.

The coil 32 can also be used to determine the rotational velocity, rotational acceleration and position of the support 12 by reading current fluctuations generated by the coil 32. In this aspect, the coil 32 could replace the magnetic-field sensor 30.

A main power switch 34 for the light emitting display apparatus 10 is provided and is mounted in an accessible location on the rotating object 18. In addition to the main power switch 34, a centrifugal-force power switch 36 can also be provided to power on the light emitting display apparatus 10 only during rotational movement thereof.

Figure 2:
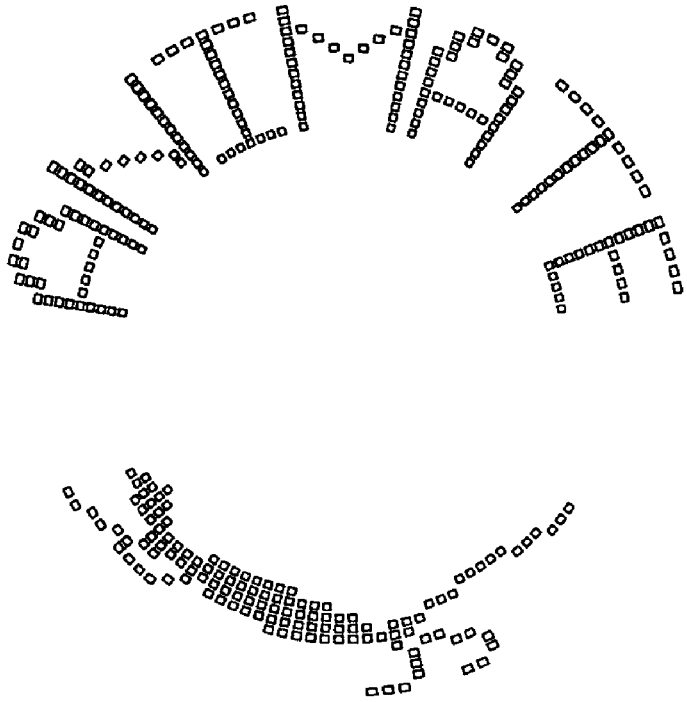
FIG. 2 is an exemplary depiction of an animated image that can be displayed by the rotational light emitting display apparatus.

Turning to FIG. 2, an exemplary animated image that can be displayed by the apparatus is shown which is capable of being displayed by the rotational light emitting display apparatus 10. This figure illustrates a single image frame of many used to display a running cat.

Figure 3:
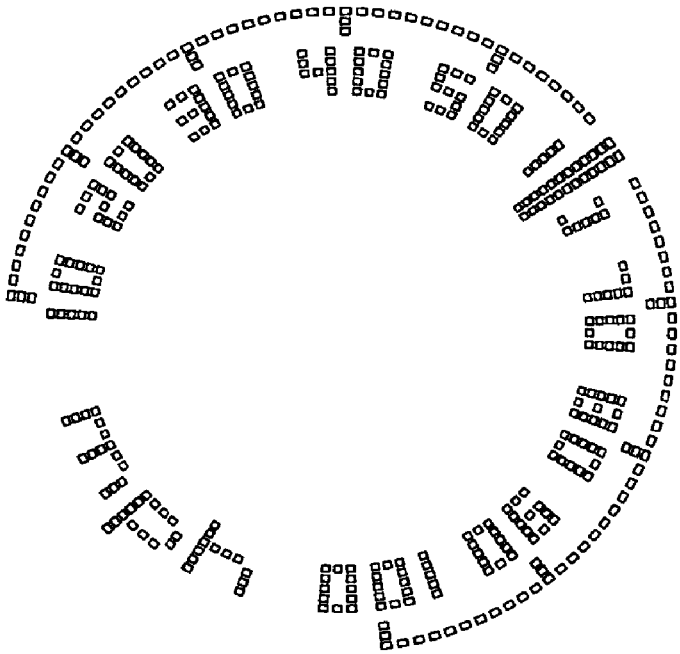
FIG. 3 is an additional exemplary depiction of an animated image that can be displayed by the rotational light emitting display apparatus.

FIG. 3 illustrates an additional exemplary animated image that can be displayed by the apparatus of an analog vehicle speedometer. As previously mentioned, the rotational light emitting display apparatus 10 is capable of determining the rotational velocity, rotational acceleration and derived quantities thereof, which all can be dynamically displayed by the light emitting display apparatus. This application is very desirable in the vehicle racing industry where the dynamic display of the vehicle's instrumentation can be provided. Preferable, the light emitting display apparatus 10 in this embodiment would be mounted to a wheel of a vehicle.

Figure 4:
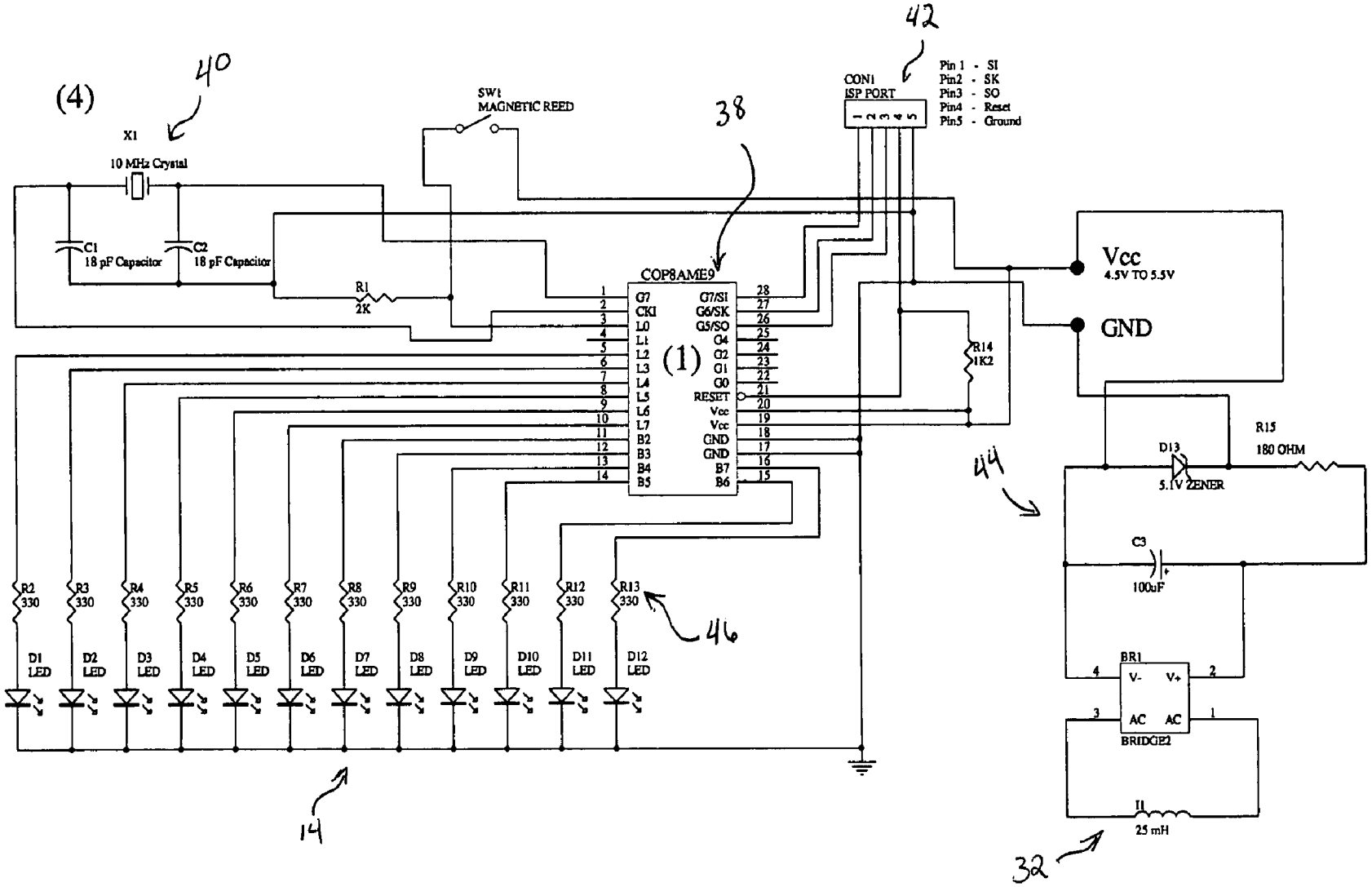
FIG. 4 is an electrical schematic of the rotational light emitting display apparatus.

Referring now to FIG. 4, an electrical schematic of an embodiment of the light emitting display apparatus 10 of the present invention is illustrated. The microcontroller 38 is connected in a standard fashion to a clock crystal circuit 40 and computer interface 42 for programming the apparatus 10. The microcontroller 38 and the other various components are powered by a battery not shown, or by a magnetic induction power circuit 44, which is connected to the coil 32. The main power switch 34 and the centrifugal-force power switch 36, which are neither illustrated in this figure would be provided in-line with the microcontroller 38 and the power source, such as the magnetic induction power circuit 44. The outputs of the microcontroller 38 are connected through current-limiting resistors 46 to the light emitting elements 14.

Figure 5:
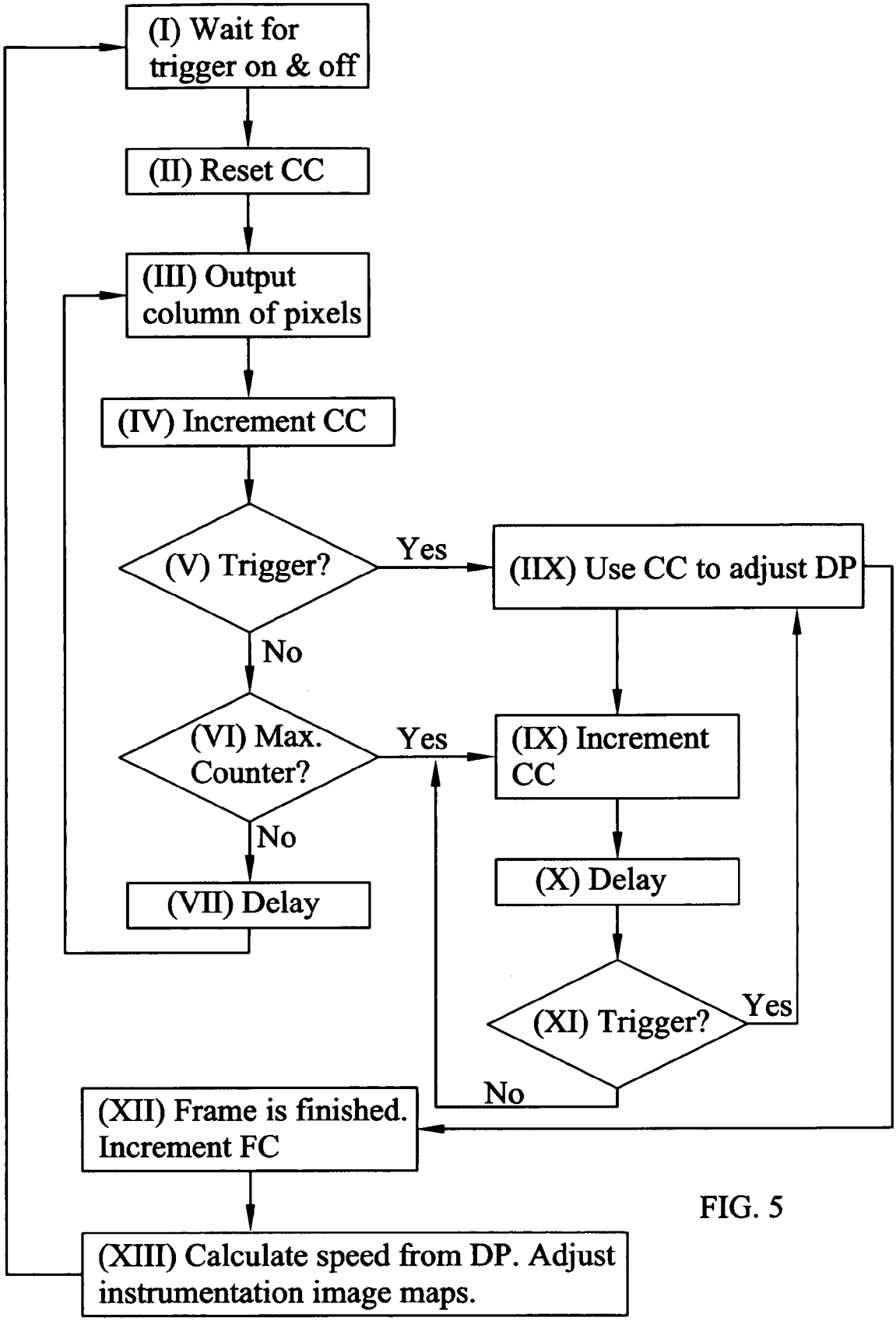
FIG. 5 is a flow diagram of the operation of the rotational light emitting display apparatus.

Turning to FIG. 5, the operation of the light emitting display apparatus 10 will be explained. The microcontroller 38 is programmed with software or firmware and operates the light emitting display apparatus 10 in accordance with the flow chart illustrated in FIG. 5. In operation of the light emitting display apparatus 10 three main variables are used, the first is the column counter (CC), the second is the delay period (DP) and the third is the frame counter (FC). Initial default values are provided in DP and FC during self-initialization of the apparatus 10. The operation begins at step I by waiting for a trigger pulse to occur which is generated by the means 26 for sensing the rotational movement and position of the support 12. Upon completion of the trigger pulse the CC is set to a numerical value of zero. At this point, a stored image map is referred to where a radial column of pixels is selected from the image map based upon the FC and CC values. The FC value determines which image map to refer to while the CC value determines which column of pixels to select within the image map. This column of pixels is sent out of the microcontroller 38 on the outputs to the light emitting elements 14 and then CC value is incremented to prepare for the next column of pixels. Step V involves checking to see if a subsequent trigger pulse occurred, and if it has then the DP value is set too high and is recomputed using the current CC value in step IIX. If the current frame is finished, which is determined by the CC value then the FC value is incremented. In Stage XIII, the DP value is used to derive the rotational speed, and taking successive differences of the rotational speed, the rotational acceleration can be derived. These derived values can be used to determine the linear velocity, linear acceleration, or power of a vehicle given that numerical constants such as wheel radius and vehicle mass are encoded into the apparatus 10. At this point, the operation of the apparatus returns to step I.

Returning now to Step V, if the trigger pulse has not occurred, then in Step VI the value of CC is checked. If it has not reached its maximum value then in Step VII a delay loop waits an amount of time proportional to the DP value after which the next column of pixels can be outputted in Step III. When the value of CC reaches a maximum value, the current frame has been completed and in Step IX, the value of CC is incremented. Then a delay waited in Step X as in Step VII until a trigger pulse is sensed, as determined in Step XI. After this loop comprised of Steps IX, X, and XI is executed, then the CC value is used in Step IIX as before to calibrate the DP value.

In summary, when the DP value is too low, the column output rate is too high, and the Step-sequence VI, IX, X, XI, IIX will be followed. When the DP value it too high, the Step-sequence V, IIX will be followed. Either Step-sequence continues through Step IIX using the CC values, which is a measure of the rotational period in units of the DP value, which is used to calculate a new DP value so that the numerical value of the rotational period so determined is made to tend to coincide with the circumferential resolution. The circumferential resolution is the maximal CC value.

While a preferred embodiment of the rotational light emitting display apparatus has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the specific microcontroller, triggering device, resolution of the image (which is determined by memory constraints, number of light emitting elements, and pixel output rate), and construction of the support and specific programming of the apparatus are all subject to variation within the spirit of the invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A light emitting display apparatus for displaying a stationary or animated image on a rotating object, the light emitting display apparatus comprising:

a support attachable to the rotating object so as to having the same center of rotation as the rotating object;

a plurality of light emitting elements on said support and arranged in one or more generally parallel columns;

one or more image maps of an image to be displayed, each image map including an array of plurality of columns;

a means for sensing the rotational position of said support about the center of rotation and generating a signal;

a microcontroller attached to each of said plurality of light emitting elements, said microcontroller receives said signal and operates to select an image map and a column from said selected image map in accordance with said signal and configured to illuminate one or more of said light emitting elements in accordance with said selected image map, said selected column and said signal, thereby displaying said image as said support is rotated about the center of rotation so as to be viewed by humans;

a power source connected to and providing electrical power to said microcontroller; and said microcontroller determines the rotational frequency of said support from said signal and using said rotational frequency determines the linear velocity of the object to which said support is attached, and wherein said image is of a speedometer which dynamically displays said linear velocity.

2. The apparatus of claim 1, wherein said microcontroller further operates to define a delay period and is further configured to illuminate one or more of said light emitting elements in accordance with said selected image map, said selected column, said signal, and said delay period.

3. The apparatus of claim 2, further comprising:

a vehicle wheel; and wherein said support is attachable to said vehicle wheel so as to have the same center of rotation as said vehicle wheel.

4. The apparatus of claim 1, further comprising:

a vehicle wheel; and wherein said support is attachable to said vehicle wheel so as to have the same center of rotation as said vehicle wheel.

5. A light emitting display apparatus for displaying a stationary or animated image on a rotating object, the light emitting display apparatus comprising:

a support attachable to the rotating object so as to having the same center of rotation as the rotating object;

a plurality of light emitting elements on said support and arranged in one or more generally parallel columns;

one or more image maps of an image to be displayed, each image map including an array of plurality of columns;

a means for sensing the rotational position of said support about the center of rotation and generating a signal;

a microcontroller attached to each of said plurality of light emitting elements, said microcontroller receives said signal and operates to select an image map and a column from said selected image map in accordance with said signal and configured to illuminate one or more of said light emitting elements in accordance with said selected image map, said selected column and said signal, thereby displaying said image as said support is rotated about the center of rotation so as to be viewed by humans;

a power source connected to and providing electrical power to said microcontroller; and said microcontroller determines the rotational acceleration of said support from said signal and using said rotational acceleration determines the linear acceleration of the object to which said support is attached, and wherein said image is of an accelerometer which dynamically displays said linear acceleration.

6. The apparatus of claim 5, further comprising:

a vehicle wheel; and wherein said support is attachable to said vehicle wheel so as to have the same center of rotation as said vehicle wheel.

7. The apparatus of claim 5, wherein said microcontroller further operates to define a delay period and is further configured to illuminate one or more of said light emitting elements in accordance with said selected image map, said selected column, said signal, and said delay period.

8. The apparatus of claim 7, further comprising:

a vehicle wheel; and wherein said support is attachable to said vehicle wheel so as to have the same center of rotation as vehicle wheel.

9. A light emitting display apparatus for displaying a stationary or animated image on a rotating object, the light emitting display apparatus comprising:

a support attachable to the rotating object so as to having the same center of rotation as the rotating object;

a plurality of light emitting elements on said support and arranged in one or more generally parallel columns;

one or more image maps of an image to be displayed, each image map including an array of plurality of columns;

a means for sensing the rotational position of said support about the center of rotation and generating a signal;

a microcontroller attached to each of said plurality of light emitting elements, said microcontroller receives said signal and operates to select an image map and a column from said selected image map in accordance with said signal and configured to illuminate one or more of said light emitting elements in accordance with said selected image map, said selected column and said signal, thereby displaying said image as said support is rotated about the center of rotation so as to be viewed by humans;

a power source connected to and providing electrical power to said microcontroller; and said object is a vehicle wheel and said microcontroller is encoded with the radius of the wheel and the vehicle mass to which the vehicle wheel is mounted, and further wherein said microcontroller determines the rotational acceleration of said support from said signal and using said rotational acceleration determines the linear acceleration of the wheel, and then using said linear acceleration determines the power of the vehicle using the said linear acceleration, the vehicle mass, and the radius of the wheel, and further wherein said image is of a vehicle instrumentation which dynamically displays the determined power of the vehicle.

10. The apparatus of claim 9, wherein said microcontroller further operates to define a delay period and is further configured to illuminate one or more of said light emitting elements in accordance with said selected image map, said selected column, said signal, and said delay period.

* * * * *